US011059618B2

(12) United States Patent
Eck

(10) Patent No.: US 11,059,618 B2
(45) Date of Patent: Jul. 13, 2021

(54) APPARATUS FOR EMPTYING A CONTAINER AND METHOD OF USE

(71) Applicant: Eck Fabrication LLC, Kingman, KS (US)

(72) Inventor: Ethan Eck, Kingman, KS (US)

(73) Assignee: ECK FABRICATION LLC, Kingman, KS (US)

( * ) Notice: Subject to any disclaimer, the term of this patent is extended or adjusted under 35 U.S.C. 154(b) by 191 days.

(21) Appl. No.: 16/405,220

(22) Filed: May 7, 2019

(65) Prior Publication Data

US 2019/0344917 A1 Nov. 14, 2019

Related U.S. Application Data

(60) Provisional application No. 62/669,059, filed on May 9, 2018.

(51) Int. Cl.
*B65B 69/00* (2006.01)

(52) U.S. Cl.
CPC ..... *B65B 69/0041* (2013.01)

(58) Field of Classification Search
CPC ..... B65B 69/0041; B65B 69/0033
See application file for complete search history.

(56) References Cited

U.S. PATENT DOCUMENTS 2,002,611 A 5/1935 Nall
2,668,550 A 2/1954 Burge
2,806,635 A 9/1957 Kader et al.
3,078,861 A 2/1963 Miller
3,139,343 A 6/1964 Christian
3,993,221 A 11/1976 Boynton et al.
4,055,066 A 10/1977 Lamendour
4,058,412 A 11/1977 Knapp et al.
4,166,481 A * 9/1979 Farris ..... B65B 69/0041 141/1

(Continued)

FOREIGN PATENT DOCUMENTS

EP 0384123 A1 8/1990

OTHER PUBLICATIONS

Focus Industrires, Inc.; Handler I,II, & III Operators Manual; Oct. 2008, Relevant portion: Parts Breakdown, p. 42; Published in U.S.

*Primary Examiner* — Jonathan Snelting
(74) *Attorney, Agent, or Firm* — Thompson Coburn LLP

(57) ABSTRACT

An apparatus for emptying a container including a body unit, a container platform, a cutting blade, and a hold-down assembly. The body unit at least partially defines a chamber, and the container platform is configured to support a container. The cutting blade is movable between a retracted position and an extended position. The cutting blade is located within the chamber when in the extended position. The cutting blade is configured to puncture a container positioned on the container platform as the cutting blade goes from the retracted position to the extended position. The hold-down assembly is configured to secure a container positioned on the container platform. The hold-down assembly is oriented such that a bracket and a shaft of the hold-down assembly are fixed relative to the body unit when an adjustable strut of the hold-down assembly is in a locked strut configuration.

20 Claims, 11 Drawing Sheets

(56) References Cited

U.S. PATENT DOCUMENTS

| | | | | | |
|---|---|---|---|---|---|
| 4,349,054 | A | * | 9/1982 | Chipman | B65B 69/0041 141/1 |
| 4,628,972 | A | | 12/1986 | LaRochelle | |
| 4,702,267 | A | | 10/1987 | Ashraff | |
| 4,846,236 | A | | 7/1989 | Deruntz | |
| 4,909,141 | A | | 3/1990 | Blenski et al. | |
| 5,174,828 | A | | 12/1992 | Roth | |
| 5,217,038 | A | | 6/1993 | Pinder | |
| 5,271,437 | A | | 12/1993 | O'Brien et al. | |
| 5,405,053 | A | * | 4/1995 | Zublin | B65B 69/0041 141/330 |
| 5,497,813 | A | | 3/1996 | Dinnis et al. | |
| 5,781,868 | A | | 7/1998 | Miller et al. | |
| 5,865,343 | A | | 2/1999 | Busch et al. | |
| 6,293,318 | B1 | | 9/2001 | Schmidt et al. | |
| 6,834,690 | B2 | | 12/2004 | Michaud | |
| 9,216,888 | B2 | | 12/2015 | Eck | |
| 9,873,138 | B2 | | 1/2018 | Eck | |
| 2005/0232731 | A1 | * | 10/2005 | Lund | B65B 69/0041 414/288 |
| 2014/0090749 | A1 | | 4/2014 | Eck | |
| 2015/0151340 | A1 | | 6/2015 | Eck | |

* cited by examiner

APPARATUS FOR EMPTYING A CONTAINER AND METHOD OF USE

RELATED APPLICATION DATA

This application claims the benefit of U.S. provisional application Ser. No. 62/669,059, filed May 9, 2018, the disclosure of which is incorporated by reference herein.

FIELD OF THE DISCLOSURE

The present disclosure relates to an apparatus for emptying a container.

BACKGROUND

Chemical substances, some of which are toxic and dangerous, are used in a number of different industries. Chemical substances are commonly distributed to end-users in containers. Depending upon the manufacturer and distributor of the chemical substance, the container may be made of a polymer or a metal. The container may also be made in varying shapes, sizes, and designs. For example, in the agricultural industry, herbicides and/or pesticides are often used by farm operators. Herbicides and pesticides are commonly distributed to farm operators in one to three gallon containers made of a polymer. In order for the herbicides and/or pesticides to be dispensed over crops or crop ground by farming equipment having a chemical tank (e.g., an agricultural sprayer), the herbicides and/or pesticides are typically manually poured one-by-one by the farm operator into the chemical mixing tank. Such a manual pouring process is laborious, time-consuming, and dangerous, as it increases the likelihood of a herbicide and/or pesticide coming into contact with a farm operator's body (e.g., skin, eyes, clothing) or being ingested via breathing or swallowing by a farm operator .

To overcome one or more of the above problems, it is desirable to have an apparatus that enables a container to be emptied into an enclosed chemical tank without having to manually pour the chemical substances within the container. Such an apparatus may result in time and labor savings, as well as a reduced risk of human exposure to a toxic chemical.

SUMMARY

One embodiment of the present disclosure is an apparatus for emptying a container. The apparatus comprises a body unit, a container platform, a cutting blade, and a hold-down assembly. The body unit at least partially defines a chamber. The container platform is configured to support a container. The container platform is located within the chamber. The cutting blade is movable between a retracted position and an extended position. The cutting blade is located within the chamber when in the extended position. The cutting blade is configured to puncture a container positioned on the container platform as the cutting blade goes from the retracted position to the extended position. The hold-down assembly is configured to secure a container positioned on the container platform. The hold-down assembly comprises a shaft, a holding arm, a bracket, and an adjustable strut. The shaft is rotatable about a rotation axis. The holding arm is connected to the shaft in a manner such that the holding arm rotates with the shaft. The holding arm has at least one container bearing surface. The container bearing surface is configured to contact a container positioned on the container platform. The bracket is connected to the shaft in a manner such that the bracket rotates with the shaft. The adjustable strut has a first end portion and a second end portion. The adjustable strut comprises a locking mechanism configured to adjust the adjustable strut between an unlocked strut configuration and a locked strut configuration. The adjustable strut is variable in length when in the unlocked strut configuration and fixed in length when in the locked strut configuration. The first end portion of the adjustable strut is connected to the body unit and the second end portion of the adjustable strut is connected to the bracket. The hold-down assembly is oriented such that the bracket and the shaft are fixed relative to the body unit when the adjustable strut is in the locked strut configuration.

Another embodiment of the present disclosure is an apparatus for emptying a container. The apparatus comprises a body unit, a container platform, a cutting blade, and a hold-down assembly. The body unit at least partially defines a chamber. The container platform is configured to support a container. The container platform is located within the chamber. The cutting blade is movable between a retracted position and an extended position. The cutting blade is located within the chamber. The cutting blade is configured to puncture a container positioned on the container platform as the cutting blade goes from the retracted position to the extended position. The hold-down assembly is configured to secure a container positioned on the container platform. The hold-down assembly comprises a shaft and a holding arm. The shaft is adjustable between a locked shaft configuration and an unlocked shaft configuration. The shaft is rotatable about a rotation axis when in the unlocked shaft configuration. The shaft is fixed relative to the body unit when in the locked shaft configuration. The holding arm is connected to the shaft in a manner such that the holding arm rotates with the shaft. The holding arm is configured to contact a container positioned on the container platform. The apparatus is configured such that a container positioned on the container platform is secured between the holding arm and the container platform when the shaft is in the locked shaft configuration.

Yet another embodiment of the present disclosure is a method of emptying a container filled with a chemical substance. The method comprises placing the container on a container platform located within a chamber. The chamber is defined by a body unit. The method further comprises rotating a shaft of a hold-down assembly such that a holding arm fixed to said shaft contacts the container. The hold-down assembly is connected to the body unit. The method further comprises locking the shaft of the hold-down assembly to prevent the holding arm fixed to said shaft from rotating. The method further comprises actuating a movable blade from a retracted position to an extended position in a manner such that the movable blade punctures the container. The holding arm secures the container between the holding arm and the container platform while the blade moves from the retracted position to the extended position.

DETAILED DESCRIPTION

Figure 1:
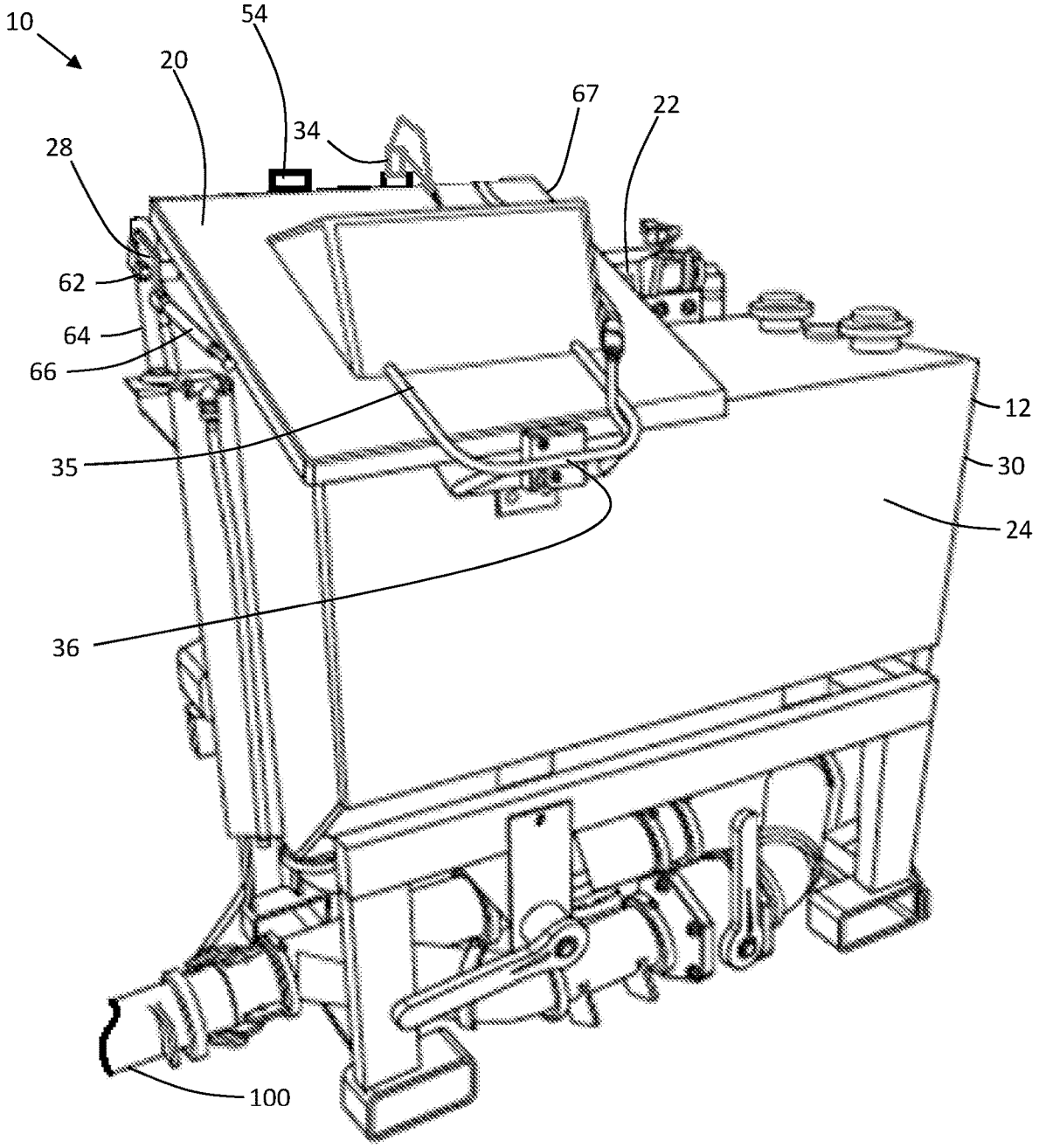
FIG. 1 is a front, left perspective view of an embodiment of an apparatus in accordance with the present disclosure.
Figure 2:
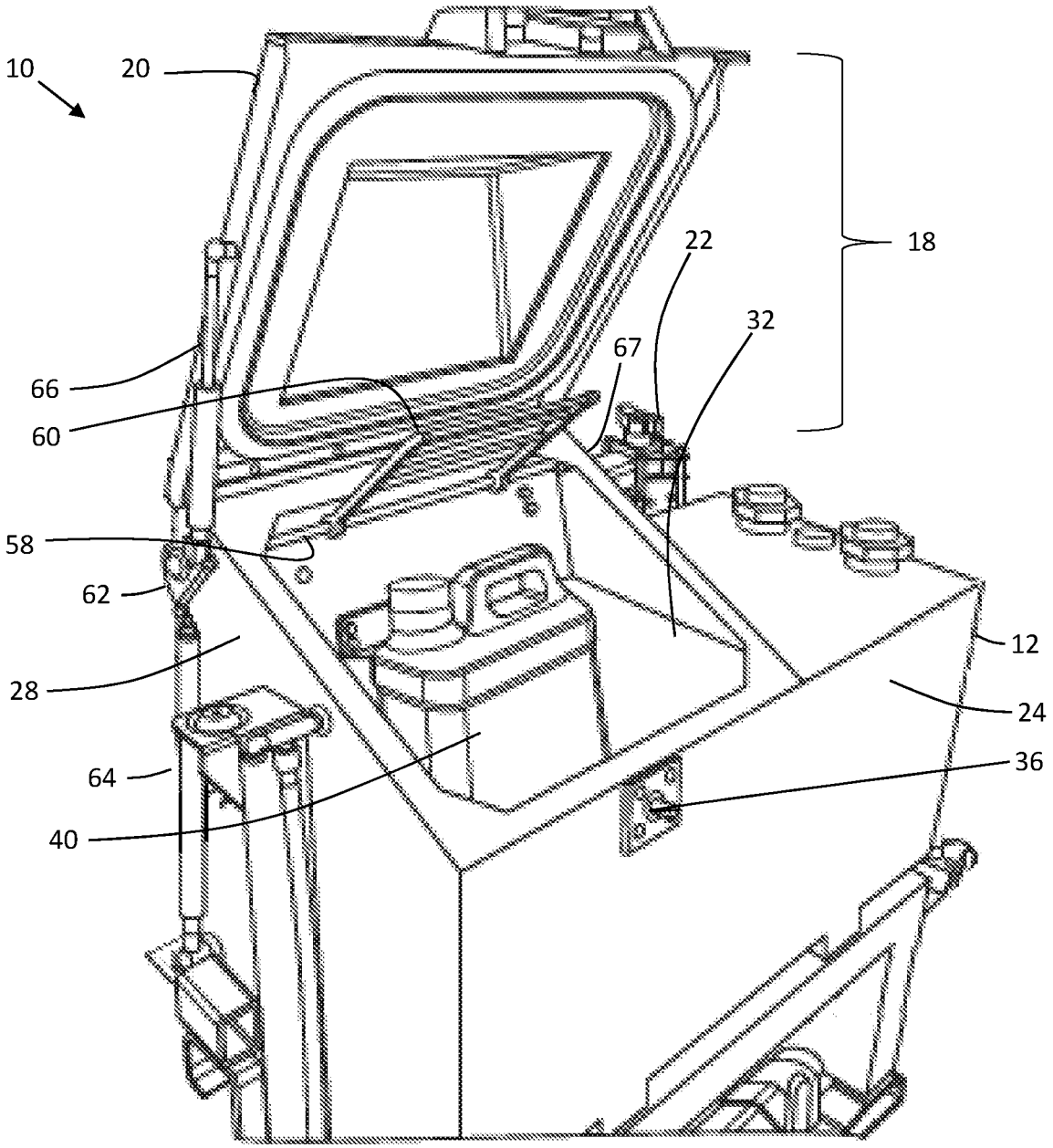
FIG. 2 is a partial front, left perspective view of the apparatus shown in FIG. 1, with a lid of the apparatus being in an open configuration.
Figure 3:
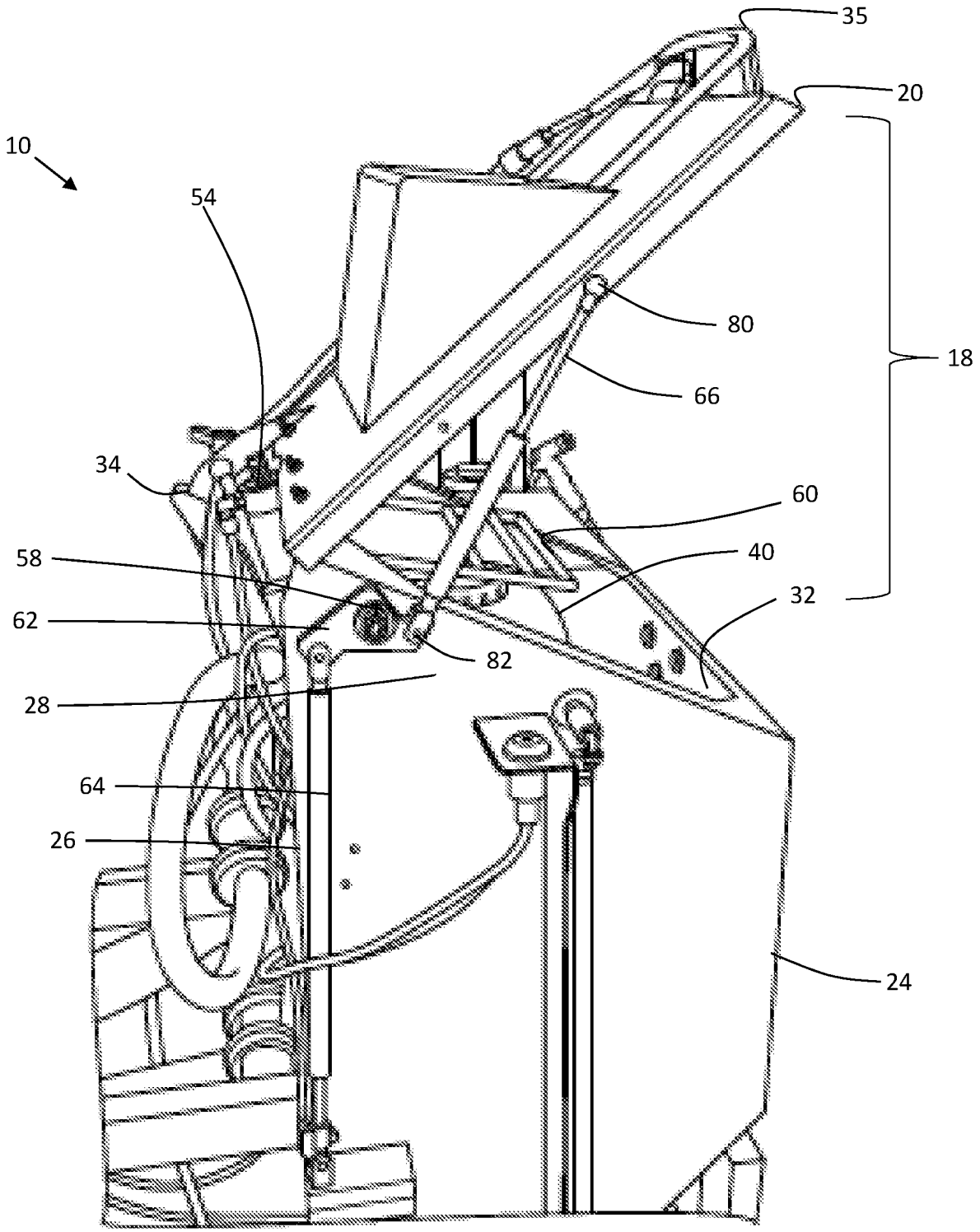
FIG. 3 is a partial left side perspective view of the apparatus shown in FIG. 1.

An embodiment of an apparatus for emptying a container in accordance with the present disclosure is indicated by reference numeral 10. The apparatus 10 includes a body unit 12, a container platform 14, a cutting blade 16, a hold-down assembly 18, a lid 20, and a control system 22. In one embodiment, the apparatus 10 may be adapted for use and operation on a ground surface within a building. In another embodiment, the apparatus 10 may be adapted for use on a mixing trailer or a mixing station used on-site in an agricultural spray operation.

The body unit 12 includes a front wall 24, a rear wall 26, a first side wall 28, and a second side wall 30 opposite the first side wall. One of ordinary skill in the art will appreciate that the main body unit 12 may differ in shape and size from the embodiment shown in FIGS. 1-12. The body unit 12 defines a chamber 32. The lid 20 is hingedly connected to the body unit 12 in a manner such that the lid is adjustable between an open configuration and a closed configuration. More specifically, in the embodiment shown in FIGS. 1-12, the lid 20 is hingedly connected to the rear wall 26 of the body unit 12. The lid 20 includes a handle 35 and a lid locking mechanism 36. The handle 35 enables a user to adjust the lid 20 between the open configuration and the closed configuration. The lid locking mechanism 36 is adjustable between an unlocked lid configuration and a locked lid configuration via the control system 22 (discussed in more detail below). The lid locking mechanism 36 enables the lid 20 to be locked with the body unit 12 when the lid is in the closed configuration and the lid locking mechanism is in the locked lid configuration. When the lid 20 is in the closed configuration, the chamber 32 is further defined by the lid. In one embodiment, the chamber 32 may form an enclosed space when the lid 20 is in the closed configuration, providing an additional layer of safety for the user as the apparatus 10 is emptying a container.

Advantageously, the apparatus 10 may further include an adjustable strut 34 variable in length and configured to bias the lid 20 to the open configuration. The adjustable strut 34 comprises a first end portion 37 and a second end portion 38. The first end portion 37 of the adjustable strut 34 is connected to the lid 20 and the second end portion 38 of the adjustable strut 34 is connected to the body unit 12. In one embodiment, the adjustable strut 34 comprises a gas spring. A person of ordinary skill in the art will appreciate that actuators other than a gas spring could be used for the adjustable strut, including, but not limited to, an air cylinder, a hydraulic cylinder, or any other linear or rotational actuators. Because the adjustable strut 34 biases the lid 20 to the open configuration, the apparatus 10 is oriented to easily receive a container whenever the apparatus 10 is not currently in use.

Figure 4:
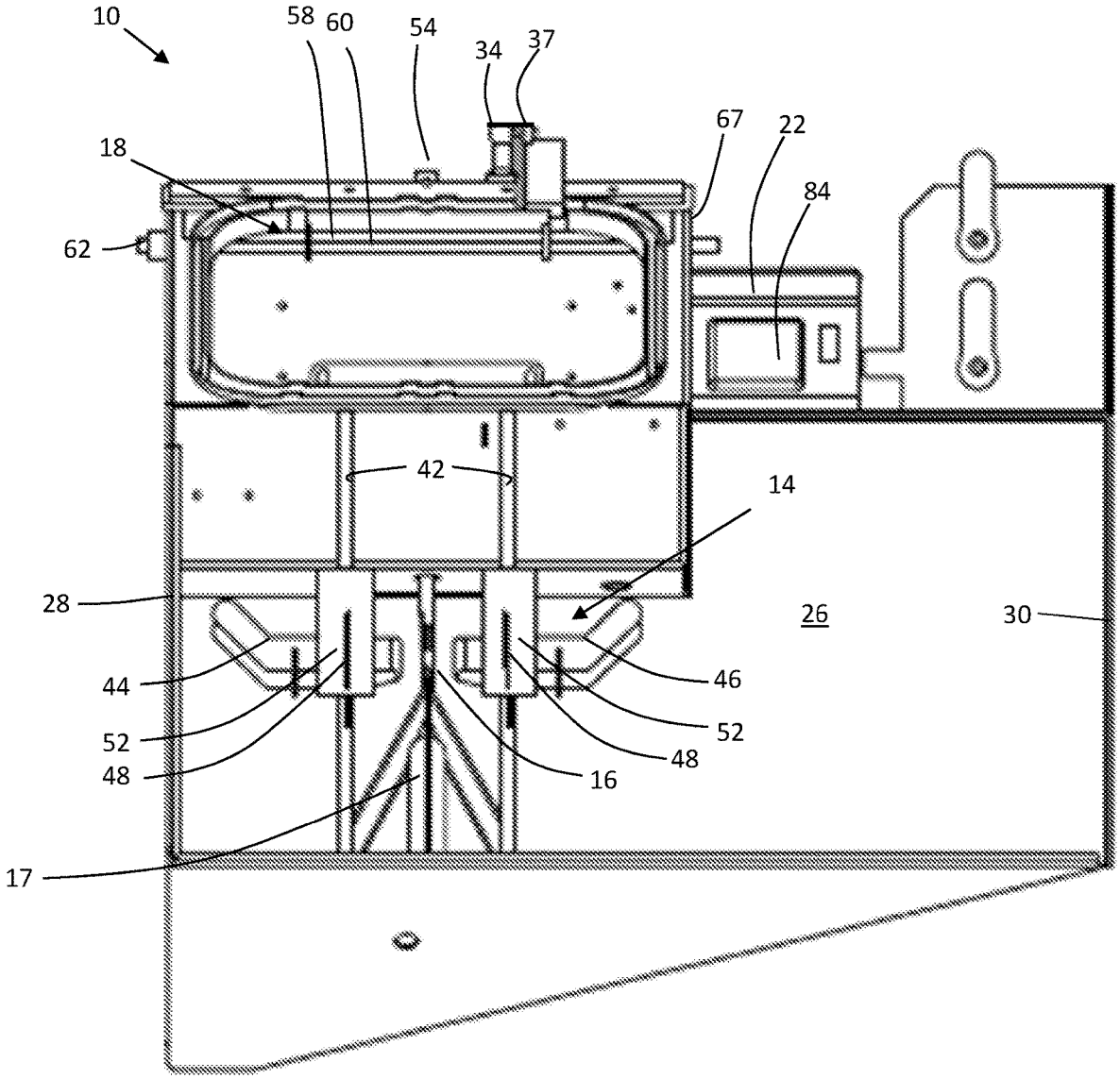
FIG. 4 is a front view of the apparatus shown in FIG. 1, with the lid and a front wall removed to show additional detail of internal structures of the apparatus.
Figure 5:
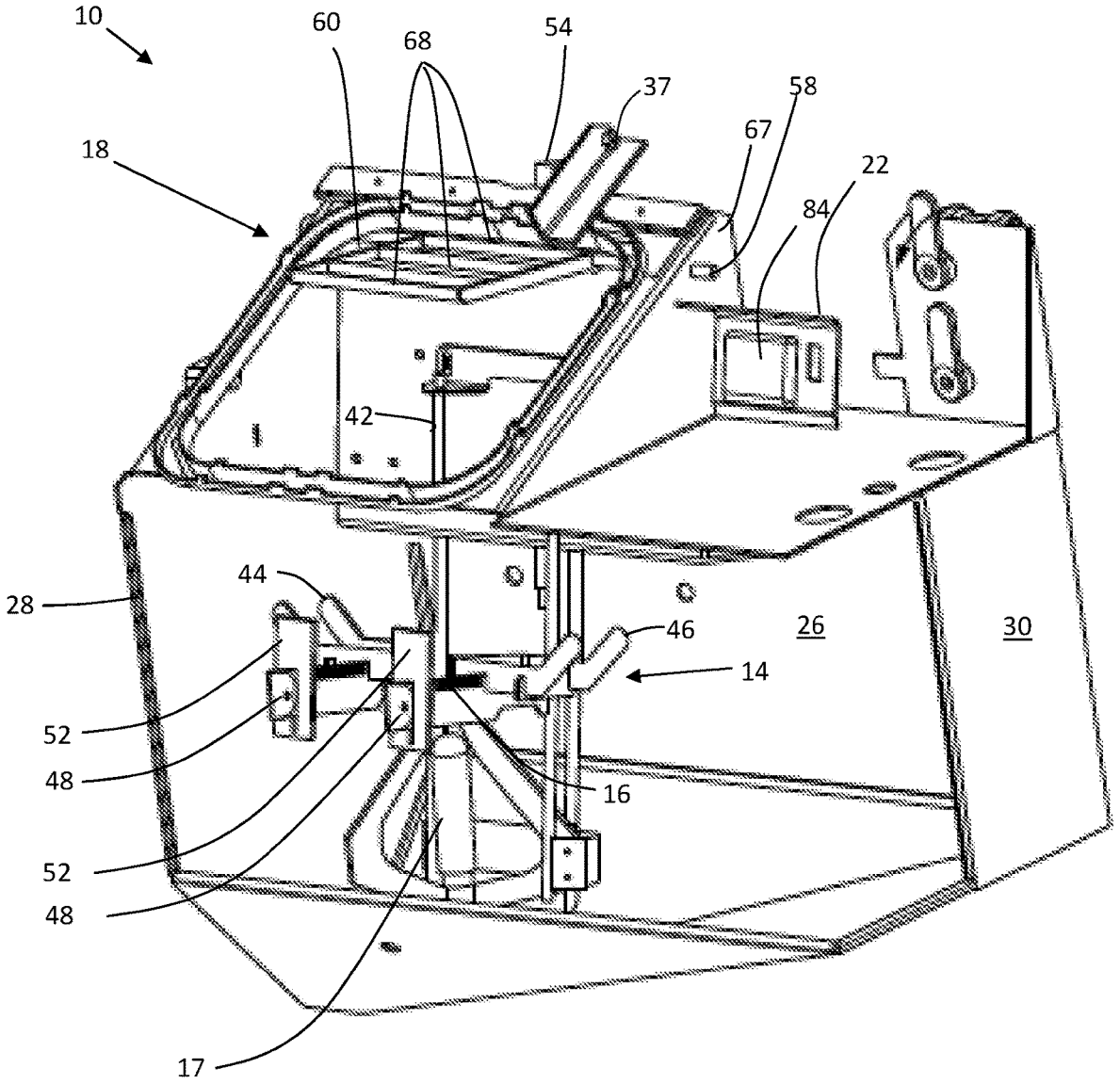
FIG. 5 is a partial front, right perspective view of the apparatus shown in FIG. 1, with the lid, the front wall, and a portion of the right side wall removed to show additional detail of internal structures of the apparatus.
Figure 6:
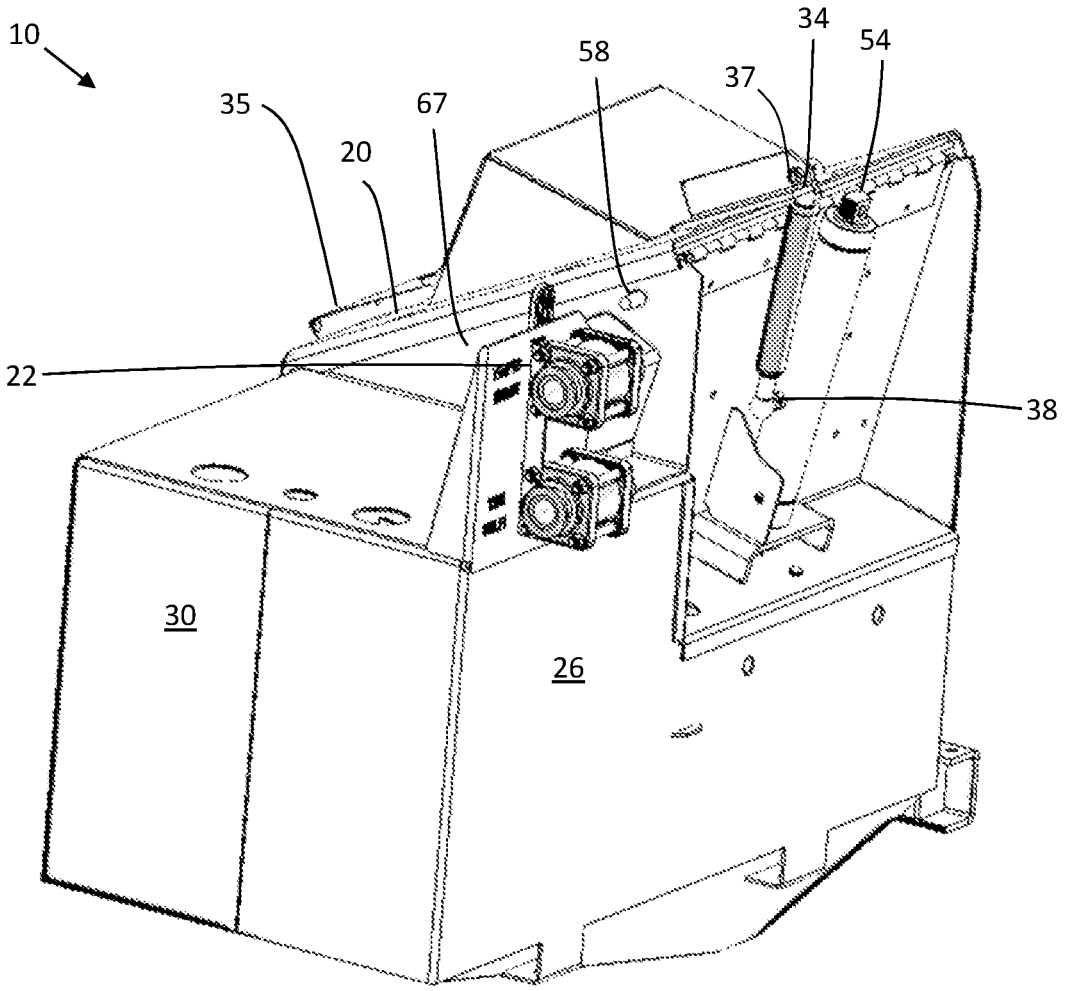
FIG. 6 is a partial rear, right perspective view of the apparatus shown in FIG. 1.
Figure 7:
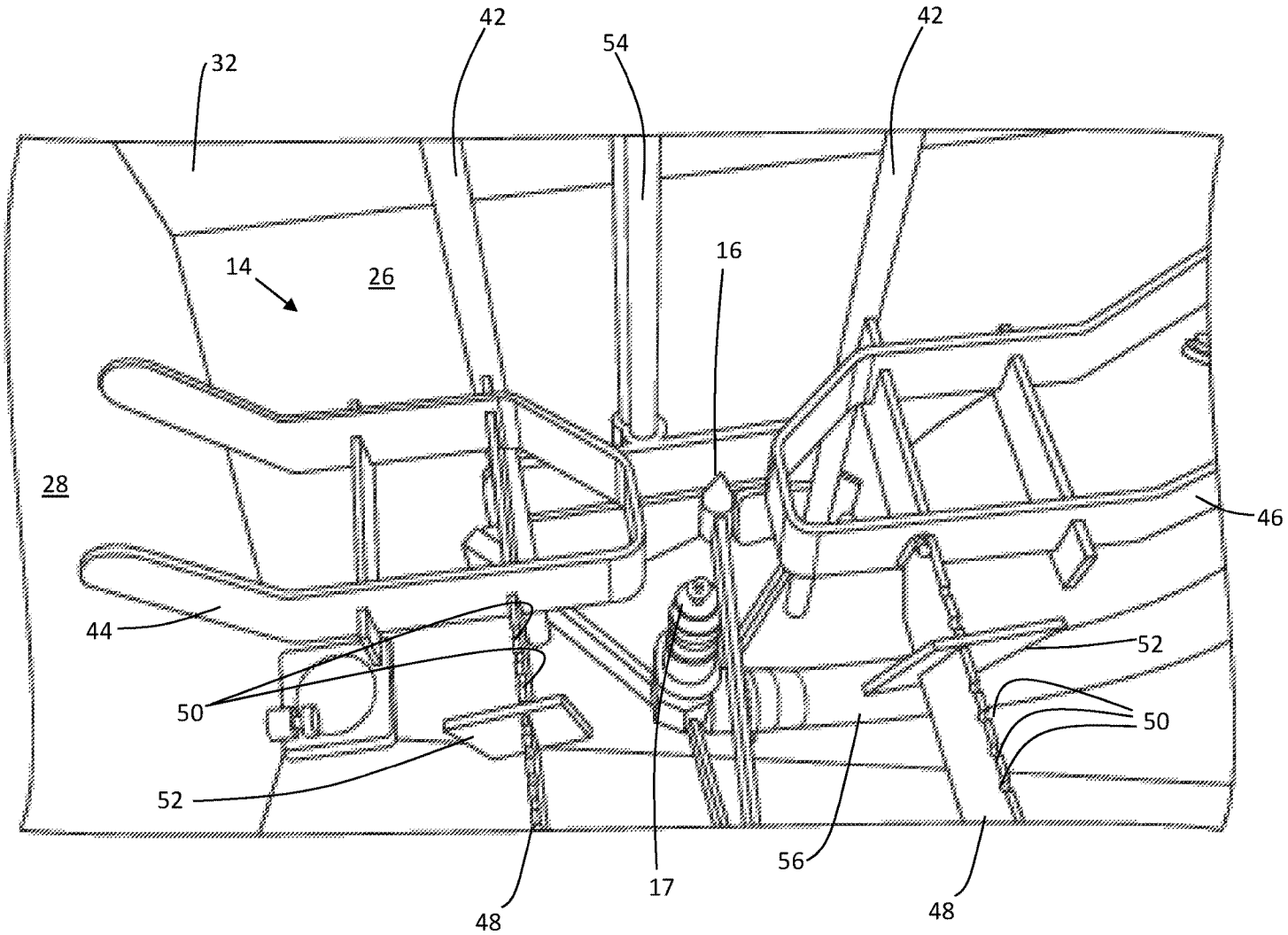
FIG. 7 is a partial, front perspective view of a container platform of the apparatus shown in FIG. 1 including a cutting blade in a retracted position and a rinse head.
Figure 8:
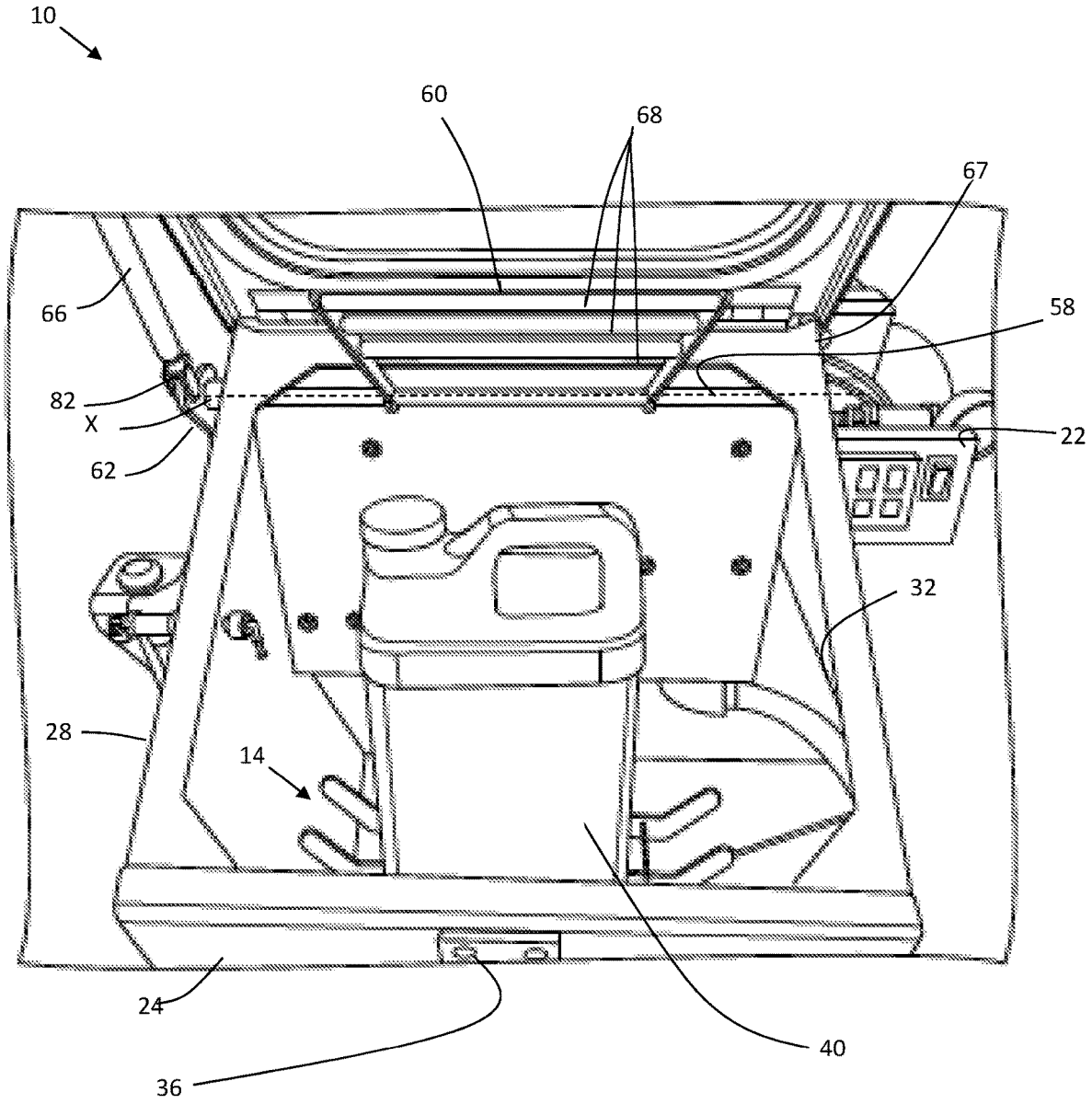
FIG. 8 is a partial, front perspective view of a container on the container platform with the lid in the open configuration and a hold down assembly in a raised configuration.
Figure 9:
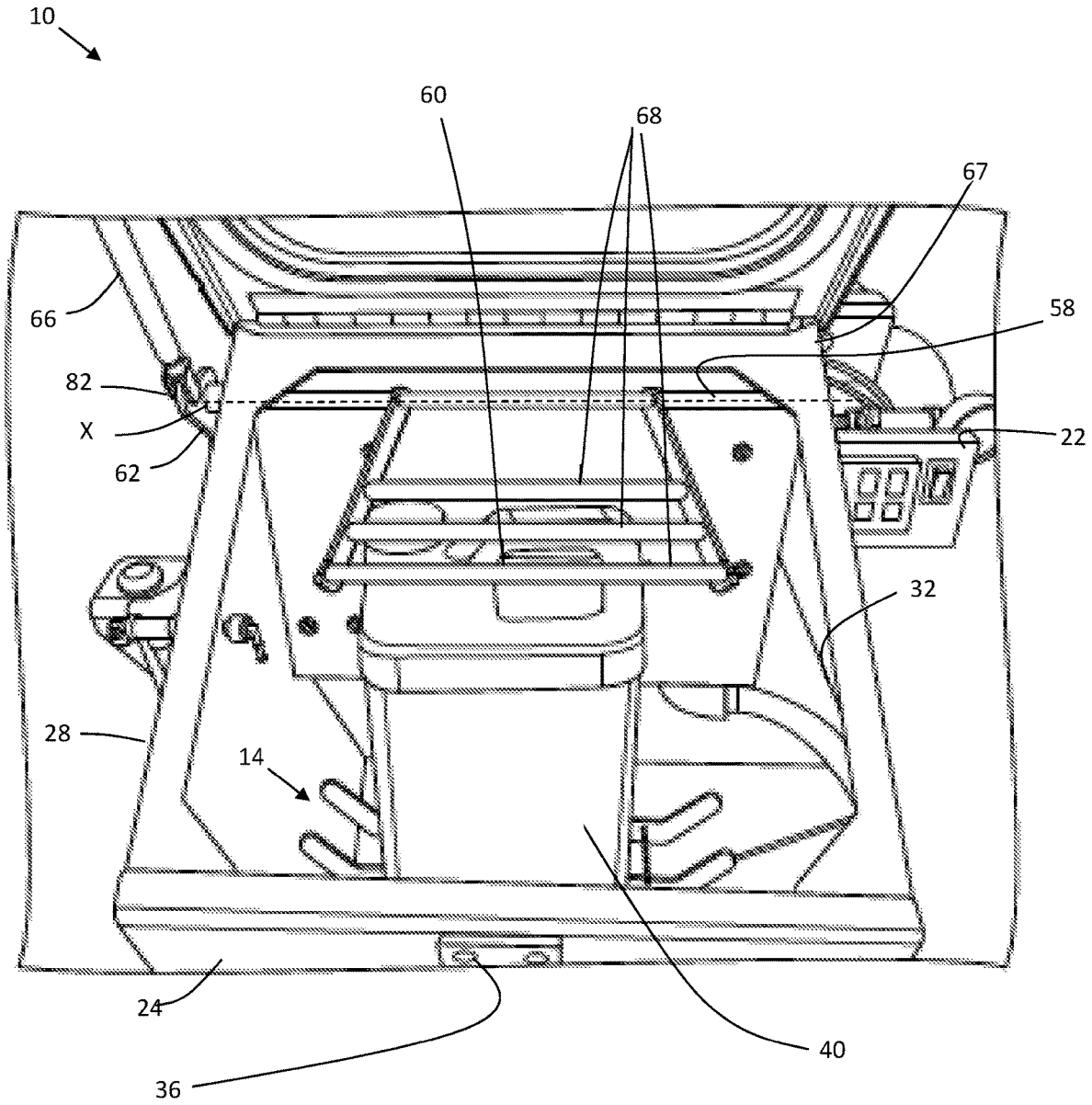
FIG. 9 is a partial, front perspective view of a container on the container platform with the lid in the open configuration and the hold down assembly in a lowered configuration.
Figure 10:
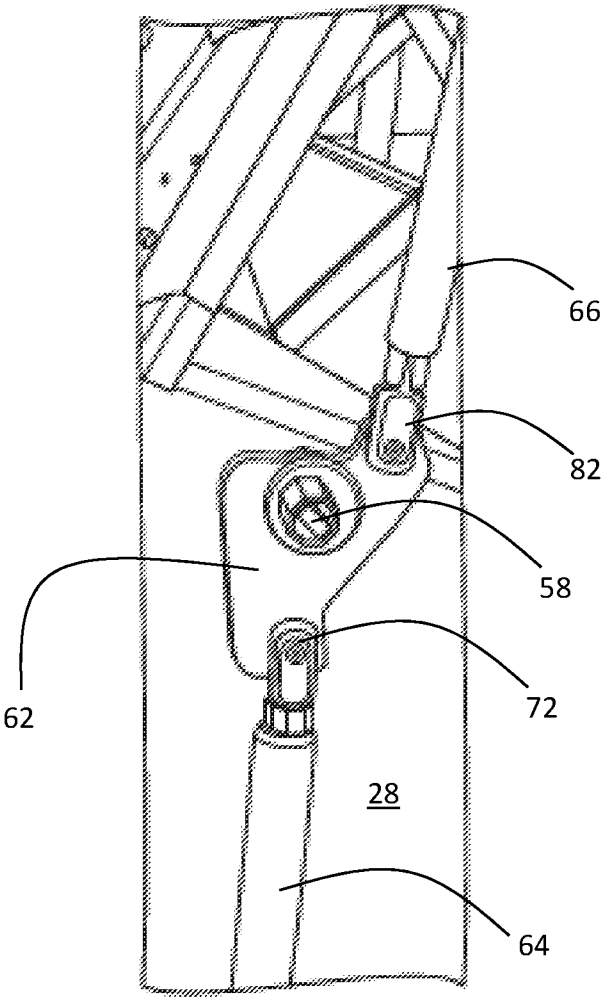
FIG. 10 is a partial, left side perspective view of the apparatus shown in FIG. 1, providing additional detail of a bracket of the hold down assembly.

As seen in FIGS. 7-9, the container platform 14 supports a container 40 filled with a chemical substance. The containers may be include plastic jugs or bags. The container platform 14 is located within the chamber 32. As best seen in FIG. 4, the container platform 14 comprises spaced apart back members 42 and a pair of spaced apart brackets 44,46, with each of the spaced apart brackets being connected to a respective back member 42 via a cantilevered support rod 48. Each support rod 48 includes a plurality of adjustment notches 50. Holding plates 52 are adjustable among the adjustment notches 50 of the support rods 48, thereby enabling the container platform 14 to accommodate containers of varying widths and sizes. In this manner, a user can adjust the positioning of the holding plates along the support rods so that the container platform snugly grips any container positioned on the container platform 14.

The cutting blade 16 of apparatus 10 is movable between a retracted position and an extended position via an air cylinder 54. As discussed in further detail below, the control system 22 controls the air cylinder 54. In the embodiment of the apparatus 10 shown in FIGS. 1-12, the cutting blade 16 is located within the chamber 32. More specifically, the cutting blade 16 is positioned such that the cutting blade is below a top surface of the container platform 14 when in the retracted position, and above the surface of the container platform and between the spaced brackets 44, 46 when in the extended position. Although the cutting blade 16 is located with the chamber 32 in both the retracted position and the extended position in the embodiment shown in FIGS. 1-12, one of ordinary skill in the art will appreciate that the cutting blade 16 may be located outside of the chamber 32 when in the retracted position. As the cutting blade 16 goes from the retracted position to the extended position, the cutting blade 16 contacts and punctures a bottom portion of the container 40 positioned on the container platform 14. The force may be approximately 400 ft-lbf. When the cutting blade 16 is in the extended position, the cutting blade is at least partially located within the container 40 positioned on the container platform 14.

In one embodiment, the cutting blade 16 may comprise a rinse head 17 configured to spray water while the cutting blade is in the extended position. The rinse head 17 may be connected to a fluid line 56 comprising a valve (not shown) adjustable between an open position and a closed position. When the valve (not shown) is in the open position, rinse fluid (e.g., water) flows through the fluid line 56 and out of the rinse head 17. In this manner, the cutting blade 16 serves the dual functions of: (1) emptying the chemical substance from the container 40 and (2) rinsing the container 40 to ensure no chemical substance remains within the container. Conversely, when the valve (not shown) is in the closed position, the valve is configured to block fluid flow through the fluid line, thereby preventing fluid from being expelled from the rinse head 17.

Advantageously, the hold-down assembly 18 secures the container 40 as the cutting blade 16 goes from the retracted position to the extended position. The hold-down assembly 18 prevents the container 40 located on the container platform 14 from retreating away from the cutting blade 16 when the cutting blade contacts the container. The hold-down assembly 18 comprises a shaft 58, a holding arm 60, a bracket 62, a first adjustable strut 64 and a second adjustable strut 66. As seen in FIGS. 8 and 9, the shaft 58 is rotatable about a rotation axis X. The shaft 58 extends between the first side wall 28 and an intermediate wall 67 extending from a top of the body unit 12 adjacent to the lid 20. More specifically, the side wall 28 and intermediate wall 67 of the body unit 12 comprise bearings (not shown) to enable the shaft to rotate about the rotation axis X. The holding arm 60 is connected to the shaft 58 in a manner such that the holding arm 60 rotates with the shaft. In other words, the holding arm 60 is fixed to the shaft 58. Advantageously, the holding arm 60 has a plurality of spaced bars 68, with each bar 68 having a container bearing surface configured to contact a container positioned on the container platform 14. The spacing and shape of the bars may create vertical and side holding force on the container when in the retracted position. In this manner, the holding arm 60 is able to accommodate a wider range of container sizes/shapes. One end of the shaft 58 passes through the first side wall 28 and connects to a bracket 62 in a manner such that the bracket rotates with the shaft.

Figure 11:
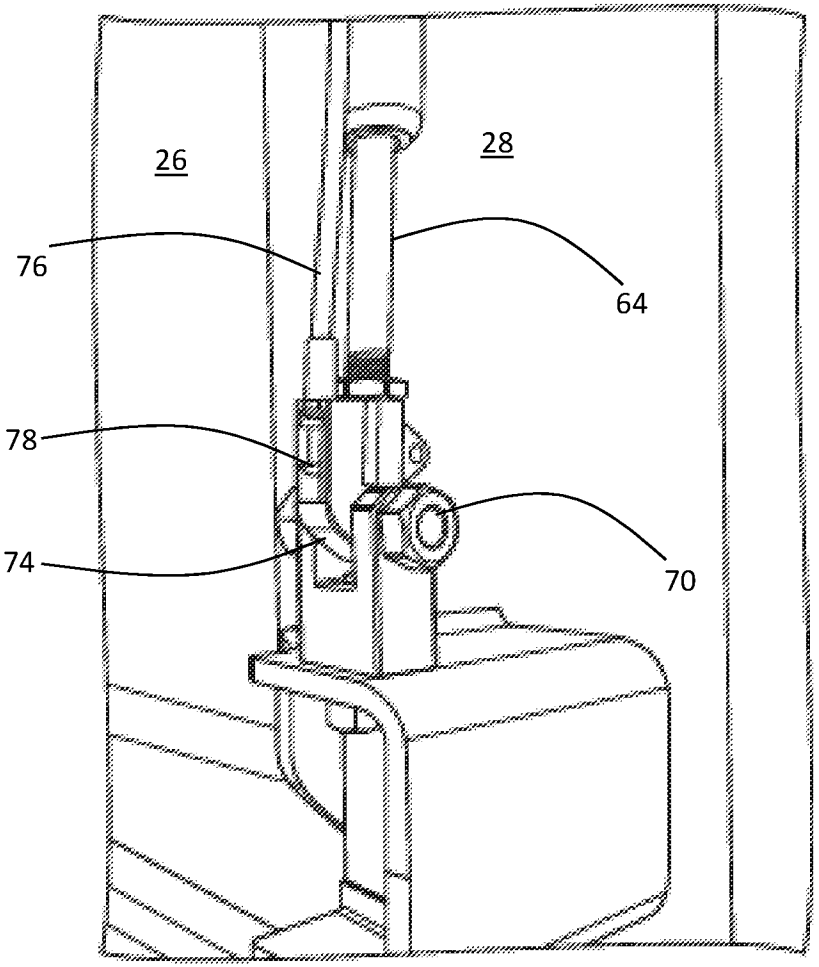
FIG. 11 is a partial, left side perspective view of the apparatus shown in FIG. 1, providing additional detail of a linkage cable and locking mechanism for a strut of the hold down assembly.
Figure 12:
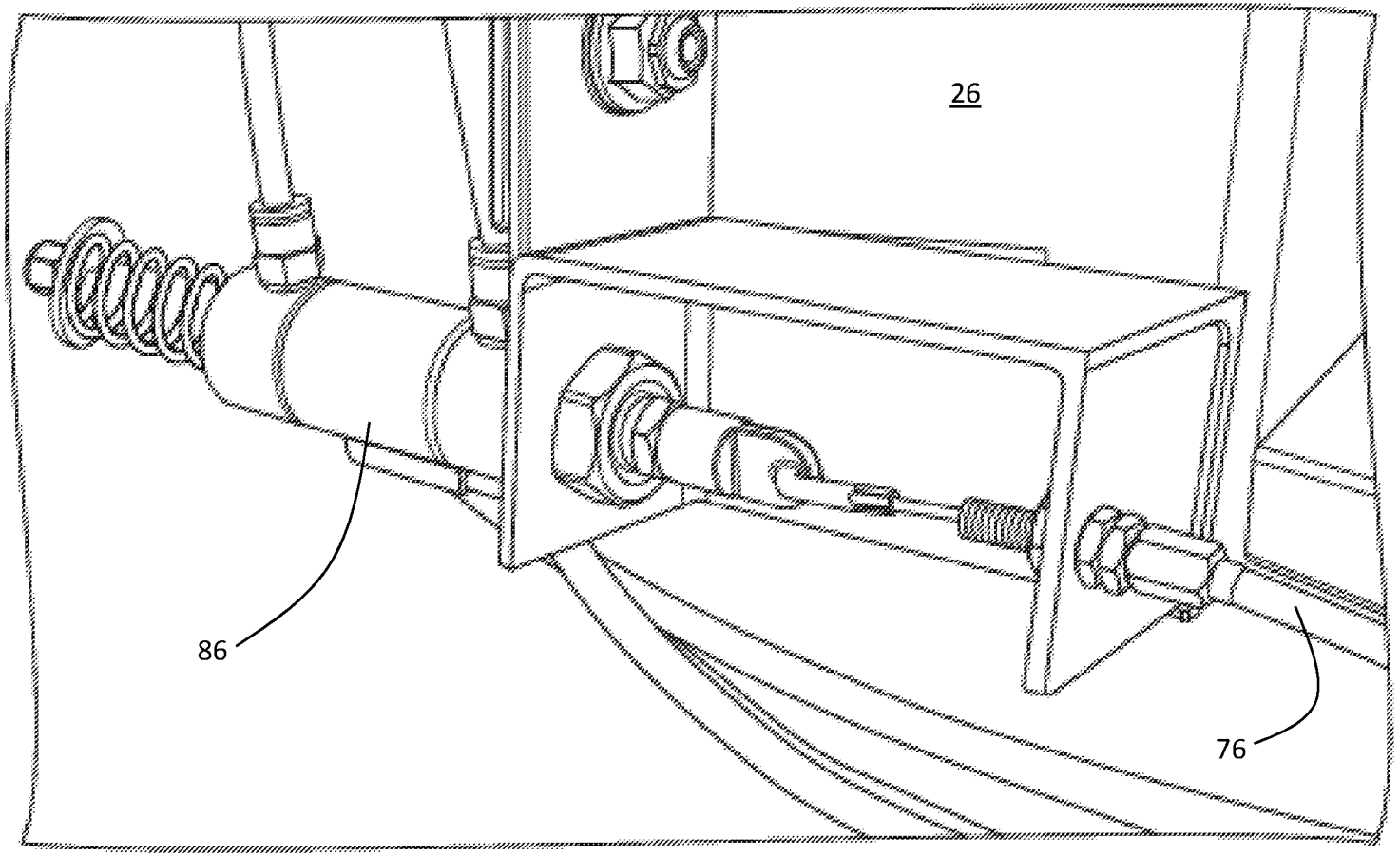
FIG. 12 is a partial, rear view of the apparatus shown in FIG. 1, showing an actuator for the linkage cable for locking and unlocking the strut of the hold down assembly.

The first adjustable strut 64 has a first end portion 70 connected to the body unit 12 and a second end portion 72 connected to the bracket 62. The second end portion 72 of the first adjustable strut 64 is pivotally connected to the bracket 62 via a fastener, thereby enabling the first adjustable strut 64 to rotate relative to the bracket 62. The first adjustable strut 64 comprises a locking mechanism 74 configured to adjust the first adjustable strut between an unlocked strut configuration and a locked strut configuration. The first adjustable strut 64 is variable in length when in the unlocked strut configuration and fixed in length when in the locked strut configuration. In one embodiment, the first adjustable strut 64 comprises a locking gas spring. A person of ordinary skill in the art will appreciate that actuators other than a gas spring could be used for the adjustable strut, including, but not limited to, an air cylinder, a hydraulic cylinder, or any other linear or rotational actuators. A movable locking pin (not shown) of the locking mechanism 74 located within the locking gas spring releases and/or locks the gas pressure, thereby enabling the locking gas spring to be adjusted between an unlocked spring configuration and a locked spring configuration. The locking pin (not shown) of the locking mechanism 74 is actuated by a linkage cable 76 that connects to a lever 78, as seen in FIG. 11. The linkage cable 76 is adjustable from a first unlocked position (which in turn means the locking gas spring is in the unlocked spring configuration) to a second locked position (which in turn means the locking gas spring is in the locked spring configuration). As the linkage cable 76 is adjusted from the first unlocked position to the second locked position, the lever 78 adjusts the locking pin (not shown) in a manner that either releases the gas pressure of the locking gas spring or locks the gas pressure of the locking gas spring. In this manner, the locking gas spring can be positioned and locked anywhere along the stroke of the locking gas spring.

The first adjustable strut 64 is connected to the bracket 62 in a manner such that when the first adjustable strut 64 is in the locked strut configuration, the bracket 62 is fixed relative to the body unit 12. This results in the shaft 58 (and thus the holding arm 60) also being fixed relative to the body unit 12, thereby securing the container 40 between the holding arm 60 and the container platform 14 as the cutting blade 16 moves from the retracted position to the extended position.

The second adjustable strut 66 of the hold-down assembly 18 also has a first end portion 80 and a second end portion 82. The first end portion 80 of the second adjustable strut 66 is connected to the lid 20 and the second end portion 82 of the second adjustable strut 66 is connected to the bracket 62. The second end portion 82 of the second adjustable strut 66 is pivotally connected to the bracket 62 via a fastener, thereby enabling the second adjustable strut 66 to rotate relative to the bracket 62. The second adjustable strut 66 is variable in length. In one embodiment, the second adjustable strut 66 comprises a gas spring. A person of ordinary skill in the art will appreciate that actuators other than a gas spring could be used for the adjustable strut, including, but not limited to, an air cylinder, a hydraulic cylinder, or any other linear or rotational actuators. The second adjustable strut 66 is connected to the lid 20 and the bracket 62 in a manner such that as the lid is adjusted from the open configuration to the closed configuration, the shaft 58 is rotated about the rotation axis X, which in turn rotates the holding arm 60 that is rigidly connected to the shaft 58. As the lid is being adjusted towards the closed configuration, the holding arm 60 contacts the container 40 located on the container platform 14 and applies a compressive force. After the holding arm 60 contacts the container 40, the force exerted against the holding arm 60 by the container 40 prevents further rotation of the shaft 58. The arrangement of the second adjustable strut 66, the bracket 62, and the lid 20 enables the holding arm 60 to come into contact with containers of varying shapes and sizes.

The control system 22 of the apparatus consists of a user display 84 having a plurality of buttons enabling a user to operate said control system. The control system 22 is configured to adjust the lid locking mechanism 36 from the unlocked lid configuration to the locked lid configuration, thereby preventing a user from opening the lid 20 while the apparatus 10 is emptying and/or rinsing a container. Advantageously, the lid locking mechanism 36 may further comprise a sensor (not shown) sensing whether the lid 20 is in the unlocked lid configuration or the locked lid configuration. The control system 22 may be adapted such that the control system precludes the cutting blade from moving from the retracted position to the extended position when the sensor (not shown) senses the lid 20 is in the unlocked lid configuration.

The control system 22 is further configured to adjust the locking mechanism of the first adjustable strut 64 from the unlocked strut configuration to the locked strut configuration. In the embodiment shown in FIGS. 1-12, the control system 22 is configured to move the linkage cable 76 from the first unlocked position to the second locked position. More specifically, the control system 22 is pneumatically connected to an air cylinder 86, which is in turn connected to the linkage cable 76. More specifically, the control system 22 is pneumatically connected to the air cylinder 86 via an air valve. The air cylinder 86 is connected to the rear wall 26 of the body unit 12. Upon receiving a signal from the control system 22, the air cylinder 86 actuates and the linkage cable 76 is adjusted from the first unlocked position to the second locked position. Advantageously, a proximity sensor (not shown) may be attached to the air cylinder 86 so that the control system 22 knows whether the linkage cable 76 is in the first unlocked position or the second locked position. This in turn enables the control system 22 to know whether the first adjustable strut 64 is in the locked strut configuration or the unlocked strut configuration. If the proximity sensor (not shown) senses that the first adjustable strut 64 is in the unlocked strut configuration, the control system 22 can preclude the apparatus from moving the cutting blade from the retracted position to the extended position. The air cylinder 86 may comprise a spring return linear actuator and may comprise a double ended rod air cylinder with spring return. Thus, when air pressure is disconnected from the unit, the spring return of the air cylinder will allow the linkage cable to return to the unlocked position enabling lifting of the lid and access to the interior of the body. Thus, the lid can open freely at any time when the unit is de-energized or air pressure is not available.

The control system 22 is further configured to move the cutting blade 16 from the retracted position to the extended position. More specifically, the control system 22 is pneumatically connected to an air cylinder 54, which is in turn connected to the cutting blade 16. More specifically, the control system 22 is pneumatically connected to the air cylinder 54 via an air valve. Upon receiving a signal from the control system 22, the air cylinder 54 actuates such that the cutting blade 16 is moved from the retracted position to the extended position. In the embodiment in which the cutting blade 16 further includes a rinse head 17, the control system 22 is also configured to adjust the valve (not shown) from the closed position to the open position, thereby enabling the cutting blade to rinse the container with a rinse cycle while the cutting blade is in the extended position. The control system 22 is configured to enable a user to increase or decrease the time associated with the rinse cycle, depending upon the chemical substance located within the container.

In operation of the apparatus 10, a user opens the lid 20 via the handle 35, thereby placing the lid in the open configuration. If the lid 20 is locked to the body unit 12 via the lid locking mechanism 36, the user presses a button on the control system 22 to adjust the lid locking mechanism to the unlocked lid configuration. A user then positions a container on the container platform 14. As discussed above, the size and shapes of the containers may vary greatly. Accordingly, the container platform 14 is designed to accommodate various types of containers. After the container is positioned on the container platform, the user adjusts the holding plates 52 along the adjustment notches 50 of the support rods 48 so that the holding plates snugly grip a bottom portion of the container, thereby preventing the container from swinging outwardly when the cutting blade 16 punctures the container. The user subsequently adjusts the lid 20 from the open configuration to the closed configuration. As the user is adjusting the lid 20, the shaft 58 rotates about the rotation axis X until a bearing surface of the holding arm 60 contacts the container positioned on container platform 14. As discussed above, the holding arm 60 and the bracket 62 are connected to the shaft 58 in a manner such that the holding arm and the bracket rotate with the shaft. Also, as discussed above, the holding arm 60 may comprise a plurality of spaced bars 68 to help the apparatus 10 accommodate various sizes and shapes of containers.

After the holding arm 60 contacts the container positioned on the container platform 14, the shaft 58, the holding arm 60, and the bracket 62 no longer rotate about the rotation axis X. Instead, as the user continues to move the lid 20 towards the closed configuration, a compression force is applied to the container via the second adjustable strut 66. Once the lid 20 is in the closed configuration, the user will adjust the settings of the apparatus 10 via the control system 22. Specifically, if the cutting blade 16 comprises rinse head 17, the user may use the control system 22 to adjust the rinse cycle time depending upon the chemical substance within the container. The user will then press a button on the control system 22 that simultaneously adjusts the lid locking mechanism 36 to the locked lid configuration, adjusts the first adjustable strut 64 to the locked strut configuration, adjusts the cutting blade 16 from the retracted position to the extended position, and opens a water valve for the rinse method to take place. Once the chemical are removed from the container 40, the inside and outside of the container are rinsed, and the chamber 32 of the body unit 12 is rinsed, the chemicals and rinse water may be drained from the chamber of the body unit and directed to chemical dispensing equipment (e.g., spraying equipment, irrigation systems, fertilizer equipment) via a pump and piping 100.

After completing the rinse and drain, the control system 22 adjusts the lid locking mechanism 36 to the unlocked lid configuration, adjusts the first adjustable strut 64 to the unlocked strut configuration, adjusts the cutting blade 16 from the extend position to the retracted position, and closes a water valve for the rinse. The user subsequently adjusts the lid 20 from the closed configuration to the open configuration. As the user is adjusting the lid 20, the shaft 58 rotates about the rotation axis X until a bearing surface of the holding arm 60 releases from the container positioned on container platform 14. As discussed above, the holding arm 60 and the bracket 62 are connected to the shaft 58 in a manner such that the holding arm and the bracket rotate with the shaft. The adjustable strut 34 assists the user in moving the lid 20 from the closed configuration to the open configuration. The process may then be repeated as needed.

In view of the foregoing, it should be appreciated that aspects of the disclosure achieve several advantages over prior art fittings. As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements of the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

The invention claimed is:

1. An apparatus for emptying a container, the apparatus comprising:

a body unit at least partially defining a chamber;

a container platform configured to support a container, the container platform being located within the chamber;

a cutting blade movable between a retracted position and an extended position, the cutting blade being located within the chamber when in the extended position, the cutting blade being configured to puncture a container positioned on the container platform as the cutting blade goes from the retracted position to the extended position; and a hold-down assembly configured to secure a container positioned on the container platform, the hold-down assembly comprising:

a shaft, the shaft being rotatable about a rotation axis;

a holding arm, the holding arm being connected to the shaft in a manner such that the holding arm rotates with the shaft, the holding arm having at least one container bearing surface, the container bearing surface being configured to contact a container positioned on the container platform;

a bracket, the bracket being connected to the shaft in a manner such that the bracket rotates with the shaft; and an adjustable strut having a first end portion and a second end portion, the adjustable strut comprising a locking mechanism configured to adjust the adjustable strut between an unlocked strut configuration and a locked strut configuration, the adjustable strut being variable in length when in the unlocked strut configuration and fixed in length when in the locked strut configuration, the first end portion of the adjustable strut being connected to the body unit in both the locked and unlocked strut configurations, and the second end portion of the adjustable strut being connected to the bracket;

wherein the hold-down assembly is oriented such that the bracket and the shaft are fixed relative to the body unit when the adjustable strut is in the locked strut configuration.

2. The apparatus of claim 1, wherein the apparatus further comprises a lid hingedly connected to the body unit, the lid being adjustable between an open configuration and a closed configuration, the lid and the body unit collectively defining the chamber when the lid is in the closed configuration.

3. The apparatus of claim 2, wherein the adjustable strut is a first adjustable strut and the hold-down assembly further comprises a second adjustable strut, the second adjustable strut comprising a first end portion and a second end portion, the first end portion of the second adjustable strut being connected to the lid and the second end portion of the second adjustable strut being connected to the bracket, the second adjustable strut being variable in length.

4. The apparatus of claim 3, wherein the hold-down assembly is configured such that the shaft rotates about the rotation axis while the lid is being adjusted from the open configuration to the closed configuration.

5. The apparatus of claim 3, wherein the holding arm applies a compression force to a container positioned on the container platform when the lid is in the closed configuration.

6. The apparatus of claim 3, wherein the first adjustable strut comprises a locking gas spring and the second adjustable strut comprises a gas spring.

7. The apparatus of claim 2, wherein the apparatus further comprises a lid biasing adjustable strut, the lid biasing adjustable strut comprising a first end portion and a second end portion, the first end portion of the lid biasing adjustable strut being connected to the lid and the second end portion of the lid biasing adjustable strut being connected to the body unit, the lid biasing adjustable strut being variable in length, the lid biasing adjustable strut being configured to bias the lid toward the open configuration.

8. The apparatus of claim 2, wherein the lid includes a lid locking mechanism, the lid locking mechanism being adjustable between an unlocked lid configuration and a locked lid configuration, the lid being locked with the body unit when the lid is in the closed configuration and the lid locking mechanism is in the locked lid configuration.

9. The apparatus of claim 1, wherein the cutting blade comprises a rinse head, the rinse head being configured to spray water while the cutting blade is in the extended position.

10. The apparatus of claim 1, wherein the container platform comprises an adjustable holding plate, the adjustable holding plate being configured to snugly grip a container positioned on the container platform.

11. The apparatus of claim 1, further comprising a fluid line in communication with the rinse head, the fluid line comprising a valve adjustable between an open position and a closed position, the valve being configured to permit fluid flow through the fluid line when in the open position, the valve being configured to block fluid flow through the fluid line when in the closed configuration.

12. The apparatus of claim 1, wherein the holding arm comprises a plurality of spaced bars, each bar having a container bearing surface.

13. An apparatus for emptying a container, the apparatus comprising:

a body unit at least partially defining a chamber;

a container platform configured to support a container, the container platform being located within the chamber;

a cutting blade movable between a retracted position and an extended position, the cutting blade being located within the chamber, the cutting blade being configured to puncture a container positioned on the container platform as the cutting blade goes from the retracted position to the extended position; and a hold-down assembly configured to secure a container positioned on the container platform, the hold-down assembly comprising:

a shaft, the shaft being adjustable between a locked shaft configuration and an unlocked shaft configuration, the shaft being rotatable about a rotation axis when in the unlocked shaft configuration, the shaft being fixed relative to the body unit when in the locked shaft configuration; and a holding arm, the holding arm being connected to the shaft in a manner such that the holding arm rotates with the shaft, the holding arm being configured to contact a container positioned on the container platform;

an adjustable strut having a first end portion and a second end portion, the adjustable strut comprising a locking mechanism configured to adjust the adjustable strut between an unlocked strut configuration and a locked strut configuration, the adjustable strut being variable in length when in the unlocked strut configuration and fixed in length when in the locked strut configuration, the first end portion of the adjustable strut being connected to the body unit and the second end portion of the adjustable strut being operatively connected to the shaft, the adjustable strut being adapted and configured such that when the adjustable strut is in the locked strut configuration, the shaft is in the locked shaft configuration;

wherein the apparatus is configured such that a container positioned on the container platform is secured between the holding arm and the container platform when the shaft is in the locked shaft configuration.

14. The apparatus of claim 13, wherein the hold-down assembly further comprises a bracket and an adjustable strut, the bracket being connected to the shaft in a manner such that the bracket rotates with the shaft, the adjustable strut having a first end portion and a second end portion, the adjustable strut comprising a locking mechanism configured to adjust the adjustable strut between an unlocked strut configuration and a locked strut configuration, the adjustable strut being variable in length when in the unlocked strut configuration and fixed in length when in the locked strut configuration, the first end portion of the adjustable strut being connected to the body unit and the second end portion of the adjustable strut being connected to the bracket, the hold-down assembly being configured such that the shaft is in the locked shaft configuration when the adjustable strut is in the locked strut configuration.

15. The apparatus of claim 13, wherein the apparatus further comprises a lid hingedly connected to the body unit, the lid being adjustable between an open configuration and a closed configuration, the lid and the body unit collectively defining the chamber when the lid is in the closed configuration, and wherein the adjustable strut is a first adjustable strut and the hold-down assembly further comprises a second adjustable strut, the second adjustable strut comprising a first end portion and a second end portion, the first end portion of the second adjustable strut being connected to the lid and the second end portion of the second adjustable strut being connected to the bracket, the second adjustable strut being variable in length, the hold-down assembly being configured such that the holding arm applies a compression force to a container positioned on the container platform when the lid is in the closed configuration.

16. The apparatus of claim 13, wherein the apparatus further comprises a lid hingedly connected to the body unity, the lid being adjustable between an open configuration and a closed configuration, the lid and the body unit collectively defining the chamber when the lid is in the closed configuration.

17. The apparatus of claim 13, wherein the apparatus further comprises a lid hingedly connected to the body unit, the lid being adjustable between an open configuration and a closed configuration, the lid and the body unit collectively defining the chamber when the lid is in the closed configuration, and wherein the apparatus further comprises a lid biasing adjustable strut, the lid biasing adjustable strut comprising a first end portion and a second end portion, the first end portion of the lid biasing adjustable strut being connected to the lid and the second end portion of the lid biasing adjustable strut being connected to the body unit, the lid biasing adjustable strut being variable in length, the lid biasing adjustable strut being configured to bias the lid toward the open configuration.

18. The apparatus of claim 13, wherein the holding arm comprises a plurality of spaced bars, each bar having a container bearing surface.

19. The apparatus of claim 13, wherein the container platform comprises an adjustable holding plate, the adjustable holding plate being movable along the container platform to engage a container positioned on the container platform.

20. A method of emptying a container filled with a chemical substance, the method comprising:

placing the container on a container platform located within a chamber, the chamber being defined by a body unit;

rotating a shaft of a hold-down assembly such that a holding arm fixed to said shaft contacts the container, the hold-down assembly being connected to the body unit;

reconfiguring an adjustable strut from an unlocked strut configuration where the adjustable strut is variable in length to a locked strut configuration where the adjustable strut is fixed in length and the adjustable strut locks the shaft of the hold-down assembly to prevent the holding arm fixed to said shaft from rotating; and actuating a movable blade from a retracted position to an extended position in a manner such that the movable blade punctures the container, the holding arm securing the container between the holding arm and the container platform while the blade moves from the retracted position to the extended position.

* * * * *